US010470257B2

(12) United States Patent
Huang et al.

(10) Patent No.: US 10,470,257 B2
(45) Date of Patent: Nov. 5, 2019

(54) MICROWAVE FREQUENCY-SELECTIVE HEATING DEVICE AND METHOD THEREOF

(71) Applicant: Sichuan University, Chengdu, Sichuan (CN)

(72) Inventors: Kama Huang, Sichuan (CN); Huacheng Zhu, Sichuan (CN); Yang Yang, Sichuan (CN); Changjun Liu, Sichuan (CN); Xing Chen, Sichuan (CN)

(73) Assignee: Sichuan University, Chengdu, Sichuan (CN)

( * ) Notice: Subject to any disclaimer, the term of this patent is extended or adjusted under 35 U.S.C. 154(b) by 344 days.

(21) Appl. No.: 15/352,604

(22) Filed: Nov. 16, 2016

(65) Prior Publication Data

US 2017/0064779 A1 Mar. 2, 2017

(30) Foreign Application Priority Data

Nov. 25, 2015 (CN) ..... 2015 1 0828660

(51) Int. Cl.

*H05B 6/70* (2006.01)
*H05B 6/68* (2006.01)
*H05B 6/64* (2006.01)

(52) U.S. Cl.

CPC ..... *H05B 6/705* (2013.01); *H05B 6/6435* (2013.01); *H05B 6/68* (2013.01)

(58) Field of Classification Search

CPC ..... H05B 6/705; H05B 6/6435; H05B 6/68
USPC ..... 219/720
See application file for complete search history.

(56) References Cited

U.S. PATENT DOCUMENTS 6,104,240 A * 8/2000 Fujimoto ..... H01P 5/185 330/86
2010/0155392 A1* 6/2010 Nordh ..... H05B 6/68 219/702
2013/0228567 A1* 9/2013 Carlsson ..... H05B 6/6447 219/702
2018/0220497 A1* 8/2018 Ibragimov ..... H05B 6/6494

* cited by examiner

*Primary Examiner* — Dana Ross
*Assistant Examiner* — Kuangyue Chen

(57) ABSTRACT

The present invention relates to a technical field of microwave heating, and more particularly to a microwave frequency-selective heating device and a method thereof. The microwave frequency-selective heating device includes: a heating chamber with a microwave feed-in device, and a frequency controller; wherein the frequency controller is connected to the microwave feed-in device. According to the microwave frequency-selective heating device and the method of the present invention, the heating frequency is adjusted by setting the microwave adjusting device, which improves a material heating uniformity while greatly increases a material microwave absorption rate, so as to solve a heating efficiency problem of the conventional technologies. According to the present invention, the frequency for the heated material is intelligently selected by the micro-processor of the microwave adjusting device, and then fed in after being adjusted by the frequency control circuit, which is effective and convenient.

3 Claims, 2 Drawing Sheets

MICROWAVE FREQUENCY-SELECTIVE HEATING DEVICE AND METHOD THEREOF

CROSS REFERENCE OF RELATED APPLICATION

The present invention claims priority under 35 U.S.C. 119(a-d) to CN 201510828660.3, filed Nov. 25, 2015.

BACKGROUND OF THE PRESENT INVENTION

Field of Invention

The present invention relates to a technical field of microwave heating, and more particularly to a microwave frequency-selective heating device and a method thereof.

Description of Related Arts

With the rapid development of modern technology, microwave energy, as a novel energy which is high-efficiency and clean, has been widely used in various fields such as industrial production and daily life. Microwave heating is "overall heating", which is a selective heating method with a direct effect on materials to be heated instead of traditional heating methods needing heat conduction medium for heating materials. As a result, heat conduction period in the medium is saved and energy consumption in the medium is reduced, which means high efficiency and energy-saving.

However, in practice of microwave heating, material heating uniformity is a problem. In order to solve this technical problem, microwave with changing frequencies is used for heating materials. However, material's microwave absorption rate is very low at several frequency points, which means a low heating efficiency.

Therefore, it is urgent to develop a novel heating method for solving the above problems (Uniformity and Efficiency).

SUMMARY OF THE PRESENT INVENTION

An object of the present invention is to provide a microwave frequency-selective heating device for improving a low heating efficiency of conventional variable-frequency heating technologies.

Accordingly, in order to accomplish the above object, the present invention provides a microwave frequency-selective heating device, comprising: a heating chamber with a microwave feed-in device, and a frequency controller; wherein the frequency controller is connected to the microwave feed-in device.

Preferably, the frequency controller comprises a microprocessor for frequency selection, a register for storing selected frequencies, and a frequency control circuit; wherein the frequency control circuit is connected to the microwave feed-in device.

Preferably, the frequency controller further comprises a displayer, and input buttons for inputting the dielectric properties of the heated material, wherein the input buttons are connected to the micro-processor.

Preferably, the microwave frequency-selective heating device further comprises a clock, wherein the frequency control circuit is connected to the microwave feed-in device through the clock.

The present invention also provides a method for microwave frequency-selective heating, comprising steps of:

A) inputting the heated material's dielectric properties through input buttons;

B) according to the dielectric properties inputted in the step A), selecting a frequency from 300 GHz to 300 MHz by a micro-processor of a frequency controller; calculating an electric field, a magnetic field, a power dissipation and a temperature under the frequency by iteration, and calculating the coefficient of variation according to $$\mathrm{Cov} = \frac{\sqrt{\frac{1}{N}\sum_{i=1}^{N}(T_i - \overline{T})^2}}{\overline{\Delta T}},$$

wherein N is a number of total i-th points, $T_i$ is a temperature of an i-th point, $\overline{T}$ is an average temperature, and $\overline{\Delta T}$ is an average temperature rise, wherein $\overline{\Delta T}=\overline{T}-293.15K$; storing the electric field, the magnetic field, the power dissipation, the temperature, and the coefficient of variation in a register; and C) selecting a heating frequency for the material, adjusting the heating frequency with a frequency control circuit, and heating the material with a microwave feed-in device.

Preferably, the method further comprises a step D) of: connecting the frequency control circuit and the microwave feed-in device through a clock; wherein the step D) is executed between the step B) and the step C).

Preferably, the step B) specifically comprises a step of: adjusting the dielectric properties through temperatures.

According to the microwave frequency-selective heating device and the method of the present invention, the heating frequency is adjusted by setting the microwave adjusting device, which improves a material heating uniformity while greatly increases a material microwave absorption rate, so as to solve the heating efficiency and uniformity problems of the conventional technologies. According to the present invention, the frequency for the heated material is intelligently selected by the micro-processor of the microwave adjusting device, and then fed in after being adjusted by the frequency control circuit, which is effective and convenient.

These and other objectives, features, and advantages of the present invention will become apparent from the following detailed description, the accompanying drawings, and the appended claims.

DETAILED DESCRIPTION OF THE PREFERRED EMBODIMENT

The present invention provides a microwave frequency-selective heating device, comprising: a heating chamber with a microwave feed-in device, and a frequency controller; wherein the frequency controller is connected to the microwave feed-in device.

Preferably, the frequency controller comprises a microprocessor for frequency selection, a register for storing selected frequencies, and a frequency control circuit; wherein the frequency control circuit is connected to the microwave feed-in device.

Preferably, the frequency controller further comprises a displayer, and input buttons for inputting dielectric properties of a heated material, wherein the input buttons are connected to the micro-processor.

Preferably, the microwave frequency-selective heating device further comprises a clock, wherein the frequency control circuit is connected to the microwave feed-in device through the clock.

The present invention also provides a method for microwave frequency-selective heating, comprising steps of:

A) inputting dielectric properties of a heated material through input buttons;

B) according to the dielectric properties inputted in the step A), selecting a frequency from 300 GHz to 300 MHz by a micro-processor of a frequency controller; calculating an electric field, a magnetic field, a power dissipation and a temperature under the frequency by iteration, and calculating a coefficient of variation according to $$\mathrm{Cov} = \frac{\sqrt{\frac{1}{N}\sum_{i=1}^{N}(T_i - \overline{T})^2}}{\overline{\Delta T}},$$

wherein N is a number of total i-th points, $T_i$ is a temperature of an i-th point, $\overline{T}$ is an average temperature, and $\overline{\Delta T}$ is an average temperature rise, wherein $\overline{\Delta T}=\overline{T}-293.15K$; storing the electric field, the magnetic field, the power dissipation, the temperature, and the coefficient of variation in a register; and C) selecting a heating frequency for the material, adjusting the heating frequency with a frequency control circuit, and heating the material with a microwave feed-in device.

Preferably, the method further comprises a step D) of: connecting the frequency control circuit and the microwave feed-in device through a clock; wherein the step D) is executed between the step B) and the step C).

Preferably, the step B) specifically comprises a step of: adjusting the dielectric properties through temperatures.

Figure 1:
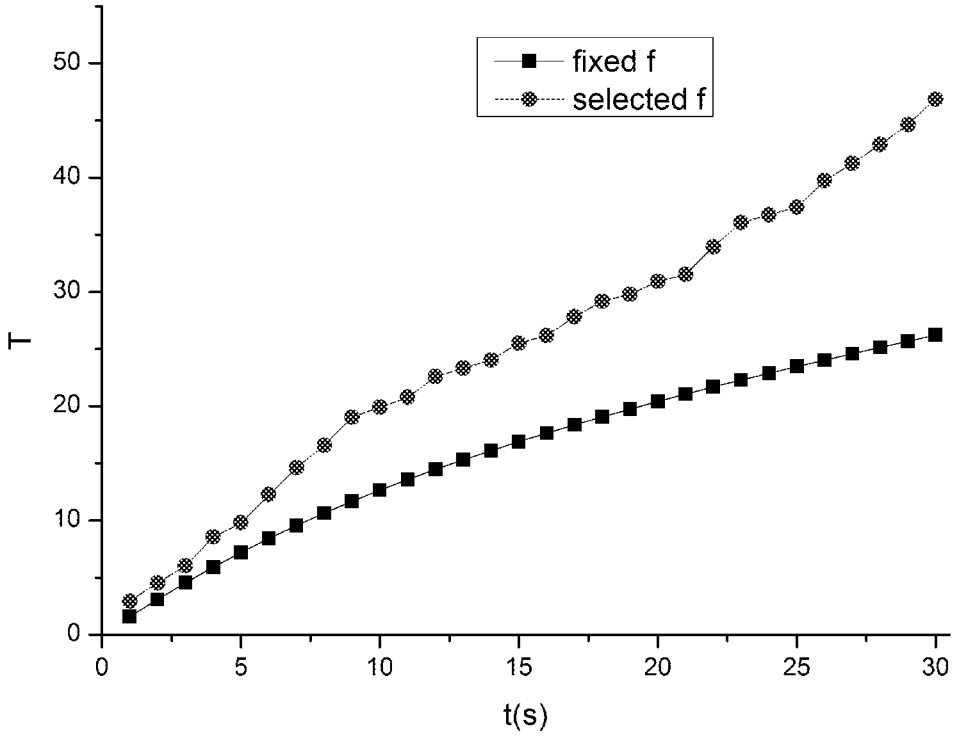
FIG. 1 illustrates an average temperature increase comparison of constant frequency heating and selective frequency heating.
Figure 2:
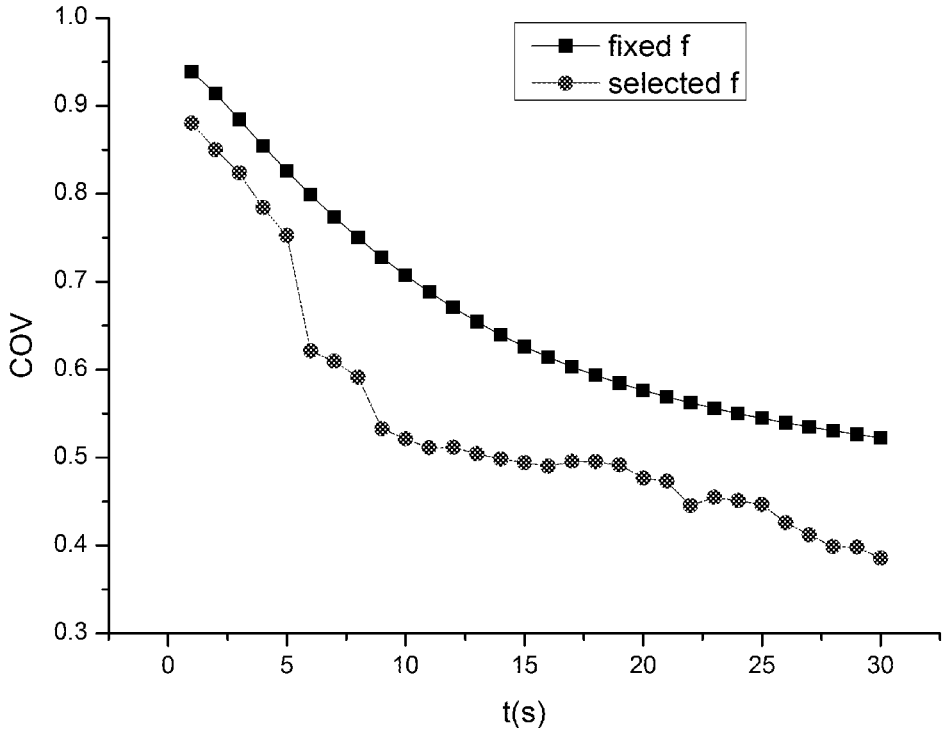
FIG. 2 illustrates a uniformity comparison of constant frequency heating and selective frequency heating.

Referring to FIG. 1 which illustrates an average temperature increase comparison of constant frequency heating and selective frequency heating, and FIG. 2 which illustrates a uniformity comparison of constant frequency heating and selective frequency heating, it is shown that after frequency selection, the heat efficiency is greatly increased without lowering the heating uniformity.

According to the microwave frequency-selective heating device and the method of the present invention, the heating frequency is adjusted by setting the microwave adjusting device, which improves a material heating uniformity while greatly increases a material microwave absorption rate, so as to solve a heating efficiency problem of the conventional technologies. According to the present invention, the frequency for the heated material is intelligently selected by the micro-processor of the microwave adjusting device, and then fed in after being adjusted by the frequency control circuit, which is effective and convenient.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for microwave frequency-selective heating, comprising steps of:

A) inputting dielectric properties of a heated material through input buttons;

B) according to the dielectric properties inputted in the step A), selecting a frequency from 300 GHz to 300 MHz by a micro-processor of a frequency controller; calculating an electric field, a magnetic field, a power dissipation and a temperature under the frequency by iteration, and calculating a coefficient of variation according to $$\mathrm{Cov} = \frac{\sqrt{\frac{1}{N}\sum_{i=1}^{N}(T_i - \overline{T})^2}}{\overline{\Delta T}},$$

wherein N is a number of total i-th points, $T_i$ is a temperature of an i-th point, $\overline{T}$ is an average temperature, and $\overline{\Delta T}$ is an average temperature rise, wherein $\overline{\Delta T}=\overline{T}-293.15K$; storing the electric field, the magnetic field, the power dissipation, the temperature, and the coefficient of variation in a register; and C) selecting a heating frequency for the material, adjusting the heating frequency with a frequency control circuit, and heating the material with a microwave feed-in device.

2. The method, as recited in claim 1, further comprising a step D) of: connecting the frequency control circuit and the microwave feed-in device through a clock; wherein the step D) is executed between the step B) and the step C).

3. The method, as recited in claim 1, wherein the step B) specifically comprises a step of: adjusting the dielectric properties through temperatures.

* * * * *